United States Patent [19]

Marcus

[11] 4,201,975

[45] May 6, 1980

[54] DISPLAY DEVICE

[76] Inventor: Herbert Marcus, 635 Redding Rd., West Redding, Conn. 06896

[21] Appl. No.: 841,561

[22] Filed: Oct. 12, 1977

[51] Int. Cl.[2] ..... B60Q 7/00; E01F 9/00; E01F 9/01

[52] U.S. Cl. ..... 340/84; 340/87; 340/114 R; 340/114 B; 116/63 R; 116/63 C; 116/63 T; 40/606; 248/158; 248/188.7; 248/519

[58] Field of Search ..... 340/84, 87, 114 B, 114 R, 340/119; 116/63 R, 63 P, 63 C, 63 T; 40/606, 607, 608, 610; 248/511, 542, 519, 440, 163, 158, 188.7, 162.1

[56] References Cited

U.S. PATENT DOCUMENTS

| | | | |
|---|---|---|---|
| 1,843,956 | 2/1932 | Otte | 116/63 P |
| 2,885,539 | 5/1959 | McDermott | 340/114 B |
| 3,135,235 | 6/1964 | Romano | 116/63 T |
| 3,862,410 | 1/1975 | Maxwell | 340/134 |
| 4,019,271 | 4/1977 | Latimer | 116/63 P |
| 4,050,401 | 9/1977 | Kelly | 116/63 P |
| 4,090,465 | 5/1978 | Bell | 116/63 R |
| 4,117,455 | 9/1978 | Cervantes | 340/114 R |

*Primary Examiner*—John W. Caldwell, Sr.
*Assistant Examiner*—Donnie L. Crosland
*Attorney, Agent, or Firm*—Gottlieb, Rackman & Reisman

[57] ABSTRACT

A highly visible display device has a base, a staff supported by the base, and a battery-operated signal device located at the top of the staff. A plurality of support poles are interconnected to form the staff, thereby enabling the display device to be erected and subsequently disassembled quickly and easily. A ballast bag is adapted to fit over the base in order to maintain the display device in place, for example against the action of high-speed vehicular traffic passing by the device. A flag may be secured to the staff to further enhance the visibility of the display device.

17 Claims, 10 Drawing Figures 28
80
82
8
14
76
78
70
72
56
74
46
50a
50b
50c
50d
50e
50f
50g
50h
52
14a
14b
14c
20
10
16
84

DISPLAY DEVICE

This invention relates generally to display devices and, more particularly, to a highly visible display device particularly useful at construction sites or to control the flow of vehicular traffic and the like.

Display devices of the type used at construction sites or to control the flow of vehicular traffic are well-known in the art and take the form of diverse shapes and configurations. For example, the display device may take the form of a series of cones placed in a lane of traffic to divert the traffic from construction, a stalled vehicle or similar blockage in the traffic lane. The display device may also take the form of a barricade, i.e., a wooden bar supported on traffic "horses", generally used at construction sites to enclose open trenches or the like.

There exists the need to provide a display device, particularly useful at construction sites or to control the flow of vehicular traffic, which is highly visible, which can be erected easily at the site where it is used and which, once erected, is maintained at its position, and which may be fabricated relatively inexpensively.

Accordingly, it is a broad object of the present invention to provide a highly visible display device.

Another object of the present invention is to provide a highly visible display device which is capable of being erected easily at the site where it is to be used.

Yet another object of the present invention is to provide a highly visible display device which, once erected, maintains its position.

Yet another object of the present invention is to provide a highly visible display device which, after the device has been used, may be disassembled relatively quickly and easily for transportation to another location or for storage.

Yet a further object of the present invention is to provide a highly visible display device which may be fabricated relatively inexpensively.

These and other objects of the present invention are obtained by providing a highly visible display device having a base, a plurality of support poles which interconnect to form a staff for the display device and which is held in an upright position by the base, a battery-operated signal device located at the top of the staff, and a ballast bag which fits over the base for maintaining the display device in place. The display device also includes a flag, at least partially of a reflective material, which is secured to the staff, thereby enhancing the visibility of the device. According to one embodiment, the base has a relatively flat and circular configuration, with outwardly directed portions or arms terminating in legs for the base. In another embodiment, the base includes a cone which holds the staff in place.

The above brief description of the present invention will become more apparent with reference to the following detailed description of presently preferred, but nonetheless illustrative, embodiments of the present invention, when taken in conjunction with the following drawings, wherein.

Figure 1:
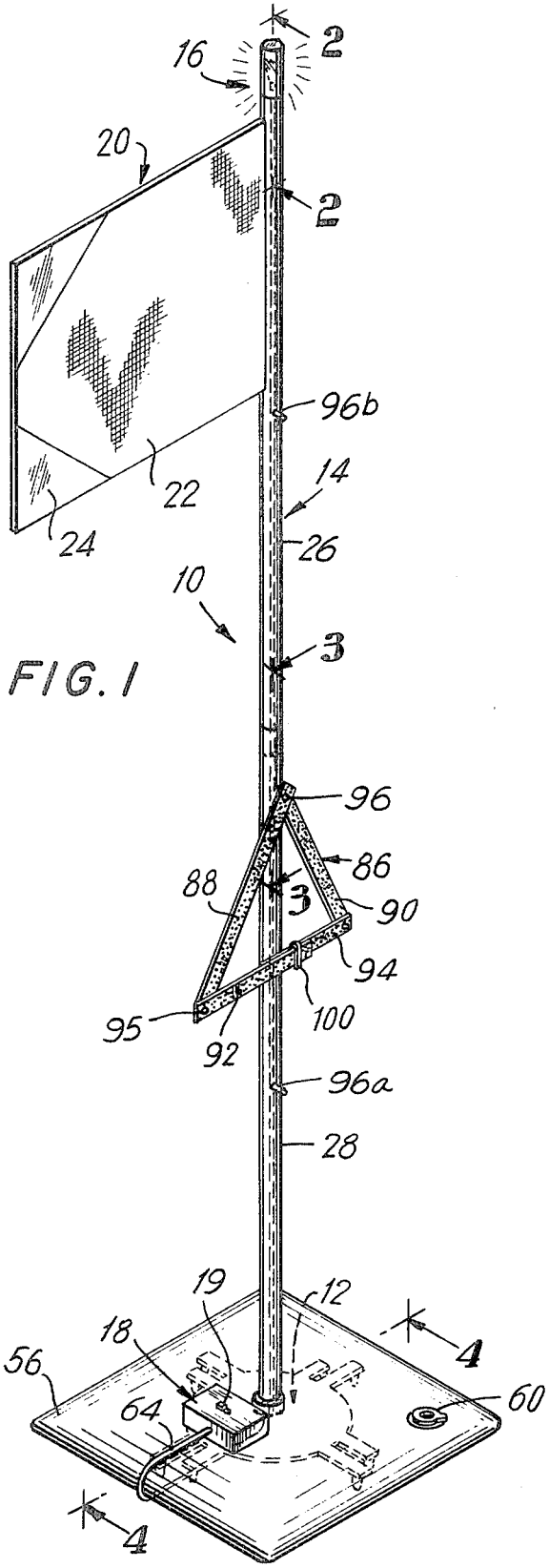
FIG. 1 is a perspective view showing a display device according to one embodiment of the present invention.

Referring now to the drawings and, more particularly, to FIGS. 1–5 thereof, a display device according to a preferred embodiment of the present invention is generally designated 10. The display device includes a base, generally designated 12, which supports a staff 14. A battery-operated signal device 16 is located at the top of staff 14, for providing either a constant light signal or an on-and-off flashing signal, for the display device. The battery-operated signal device is powered by a conventional battery pack 18, having a control switch 19.

The display device 10 may also include a flag 20, formed of at least a partially reflective material 22. The flag may fit in a frame 24 which is attachable near the upper end of staff 14 and which also holds the flag 20 in an extended position for easy visibility.

Figure 2:
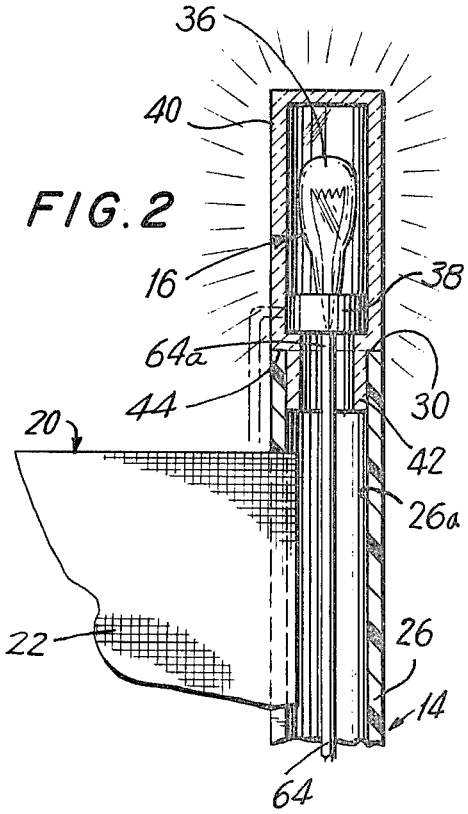
FIG. 2 is a sectional view, enlarged in scale, taken along the line 2—2 of FIG. 1.
Figure 3:
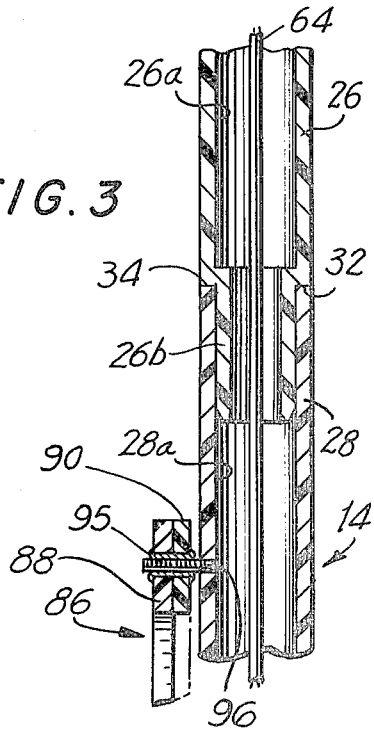
FIG. 3 is a sectional view, also enlarged in scale, taken along the line 3—3 of FIG. 1.

Referring to FIGS. 1–3, it will be noted that staff 14 is formed from a plurality of support poles, such as a top support pole 26 and a bottom support pole 28, which are interconnected together. By way of example, each support pole is approximately 30 inches in length, with the number of support poles making up staff 14 being a function of the overall height that is desired for the display device.

As shown in FIGS. 2 and 3, the top support pole 26 is generally hollow and tubular in shape, having wall **26*a* which is circular in cross-section. The wall 26*a* terminates at the upper end of the support pole in a shoulder 30, while the other end of the support pole terminates in a slightly narrower annular wall 26*b* which is formed to include a shoulder 32. As illustrated in FIG. 3, the narrower portion 26*b* of the top support pole 26 is adapted to fit into, and be frictionally held in place by, annular wall 28*a* of the bottom support pole 28, with the shoulder 32 of the top support pole abutting the shoulder 34 of the bottom support pole 28. Thus, the narrower portion 26*b* of the top support pole 26 forms an extension which is narrower in cross-section than the rest of the support pole; while the bottom support pole 28 terminates at its upper end in a cavity adapted to receive the extension of the adjacent pole. In this manner, staff 14** may be quickly and easily erected by inserting the narrower ends of the support poles within the wider ends of adjacent support poles. The staff may be similarly disassembled, by removal of the support poles, one from the other.

Figure 4:
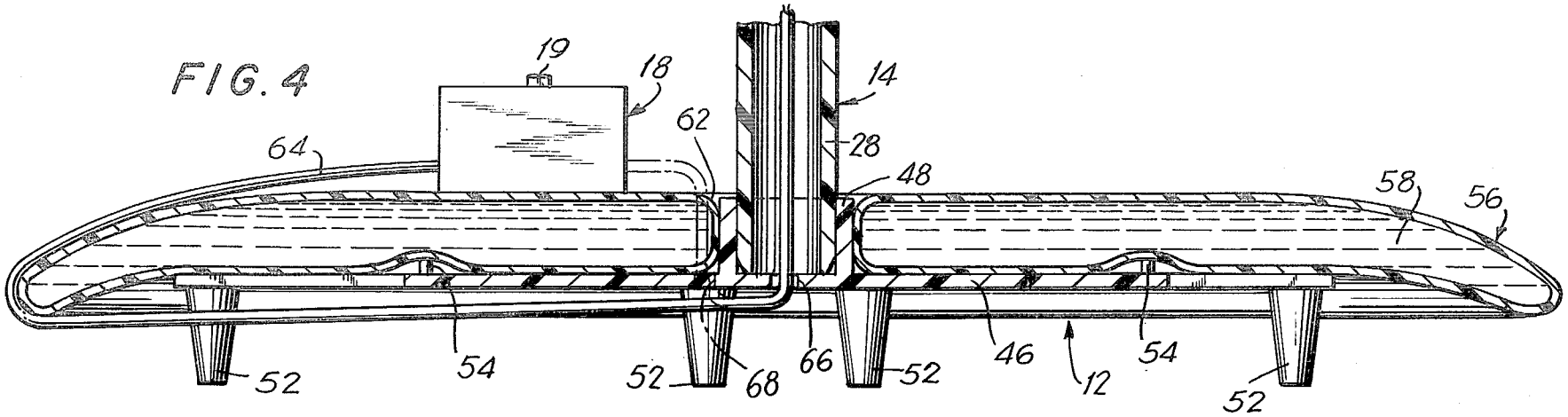
FIG. 4 is a sectional view, enlarged in scale, taken along the line 4—4 of FIG. 1.
Figure 5:
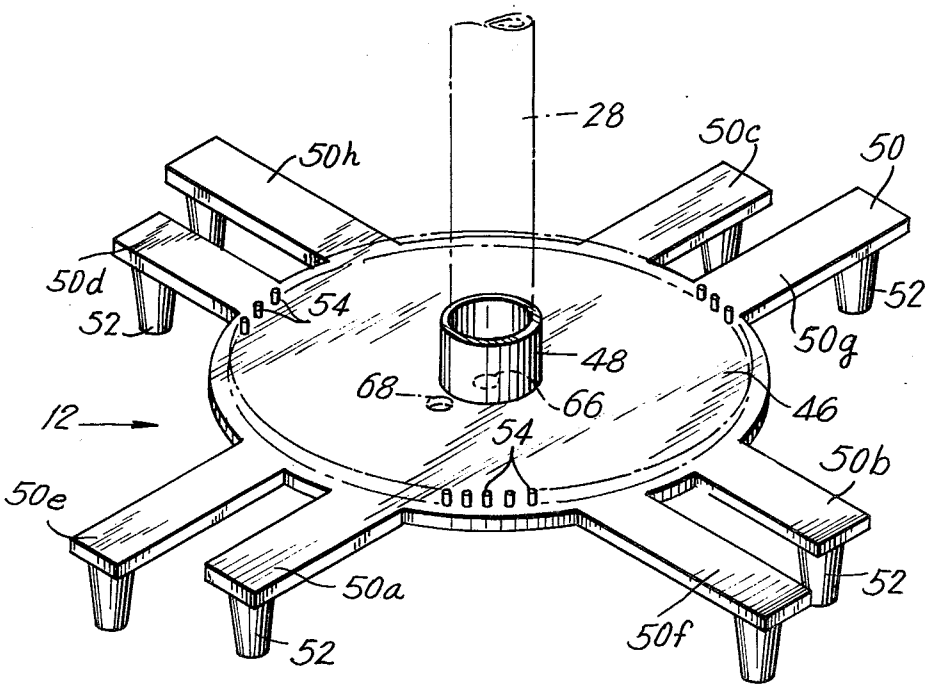
FIG. 5 is a perspective view showing one form of a base used with the display device.

The staff 14 of display device 10 is held in an upright position by base 12, which engages the lower support pole 28 of the staff. Referring to FIGS. 4 and 5, according to one embodiment of the invention, base 12 has a relatively flat and circular configuration, having a circular plate 46. A socket 48 extends upwardly, at the center of plate 46, for receiving the end of bottom support pole 28 (see FIG. 4). The plate 46 also includes a series of outwardly directed arms 50, each of which terminate in legs 52 for base 12. In the embodiment illustrated in FIG. 5, base 12 has eight arms 50—four short arms 50*a*, 50*b*, 50*c* and 50*d* and four longer arms 50*e*, 50*f*, 50*g* and 50*h*. The arms are advantageously arranged in "pairs" disposed approximately 90° from each other. Thus, short arm 50*a* is adjacent and parallel to long arm 50*e*; short arm 50*b* is adjacent and parallel to longer arm 50*f*—and "pair" 50*a*, 50*e* is approximately 90° from "pair" 50*b*, 50*f*; etc. Moreover, the short arms are aligned with the longer arms of opposite pairs. For example, short arm 50*a* is generally aligned with, but opposite from, longer arm 50*g*; longer arm 50*e* is aligned with, but opposite from, short arm 50*c*; etc. By locating the various short and long arms in this manner, the arms, along with the legs 52, provide a stable base or support for the display device 10 and, more particularly, for the staff 14 which is supported by the base, since the arrangement of arms helps to insure that the legs 52 adequately support the base despite variations in the terrain upon which the base is set.

The circular plate 46 also includes a series of upwardly extending pegs 54, which are located near the periphery of the plate, and which function to help "grip" a ballast bag 56 which rests over base 12. The ballast bag 56 is of canvas, plastic or similar material, and is filled with sand or a comparable substance 58 through a plug opening 60 (see FIG. 1). Advantageously, the ballast bag 56 is large enough to fit over the base 12, with the ballast bag functioning as a weight for maintaining the base and, therefore, display device 10, in place against wind caused, for example, by the rush of vehicular traffic past the display device. The ballast bag 56 may also include a doughnut-like opening 62 (see FIG. 4) at the center of the bag, for enabling the bag to fit over socket 48 of the base.

The battery-operated signal device 16 is located at the top of staff 14. This signal device takes the form of a light or similar illuminating device 36 connected to a base 38. The base is secured within a transparent or translucent cap 40. The cap terminates, at one end, in a circular wall 42 which defines a shoulder 44. Thus, and as shown in FIG. 2, the cap fits on top of the top support pole 26, with shoulder 44 of the cap abutting shoulder 30 of the support pole and with the cap held in place by frictional engagement of wall 42 of the cap with wall 26*a* of the top support pole.

The battery-operated signal device 16 is powered by a conventional battery pack 18 which may rest on the ballast bag 56. The battery pack is connected to the signal device by conventional electrical leads (not shown) located within a wire 64 which runs from the battery pack to the signal device. The wire may extend through the interior of the staff 14, with the wire going from the left-hand side of the battery pack, around and underneath the ballast bag 56, underneath the base 12 and then through an opening 66 located at the center of the circular plate 46 of the base, within socket 48, as shown in FIG. 4. Alternatively, and as illustrated in dot-and-dashed line in FIG. 4, the battery pack may be turned around so that the wire extends from the right-hand side of the battery pack, through the opening 62 of the ballast bag, and then through an opening 68 adjacent but outside socket 48 of the base. The wire then continues through opening 66 of the base and through the hollow, central portion of the staff 14. By having the wire 64 travel through the hollow, central portion of the staff 14, the wire is protected to some degree from the effects of wind, rain, etc. However, if desired, the wire 64 from the battery pack 18 may travel along the outside of the staff, as shown in dot-and-dashed line in FIG. 2. In such a case, and should the display device be used for any period of time, it may be desirable to affix the wire 64 to the outside of staff 14 by means of suitable adhesive tape or the like.

The end 64*a* of wire 64, adjacent the signal device 16, advantageously includes a male plug (not shown) which mates with a corresponding female plug located in the base 38 of the signal device. Advantageously, the base includes two female plugs, one at the bottom of the base, and the other at the side of the base, for receiving the male plug of wire 64, depending on whether wire 64 travels through the hollow portion of the staff 14 or along the outside of the staff, respectively. In the case where the wire is to travel along the outside of the staff, the cap 40 includes an aperture or similar passageway which enables the wire to pass through the cap and be plugged into the signal device (see FIG. 2).

Figures 6, 7, 8, 9, 10:
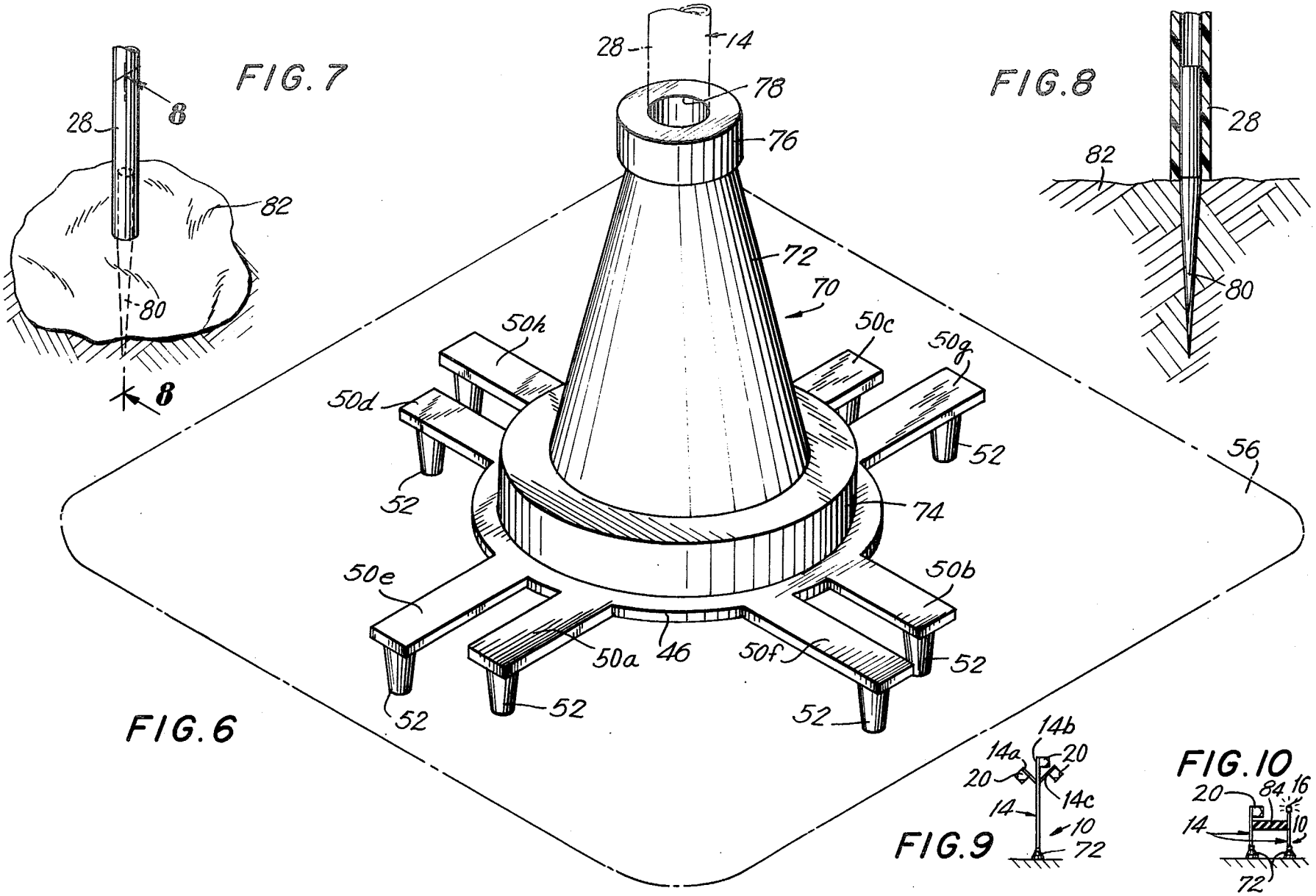
FIG. 6 is a perspective view, similar to that of FIG. 5, but showing another form of a base according to another embodiment of the present invention.
FIG. 7 is a perspective view, showing another form of a base according to another embodiment of the present invention.
FIG. 8 is a sectional view, taken along the line 8—8 of FIG. 7.
FIG. 9 is a schematic view showing the display device with three flags according to another embodiment of the present invention.
FIG. 10 is a schematic view showing the display device having a barricade configuration according to another embodiment of the present invention.

FIG. 6 illustrates a base 70 according to another embodiment of the present invention. Base 70 is similar to base 12 in that both bases include a circular plate 46, short and long arms 50*a*–50*d* and 50*e*–50*h*, respectively, terminating in legs 52. However, base 70 includes a cone-like device 72 having a cone ring 74 which is secured to the circular plate 46, thereby securing the cone to the base. The cone also includes a top cone ring 76 which has an opening 78 for receiving the staff 14 of the display device, as indicated by the dot-and-dashed representation of the bottom support pole 28 shown in FIG. 6. The cone 72, which may be similar to conventional "traffic" cones, adds weight and stability to the base and also provides a visual presentation at the bottom of the display device 10. The ballast bag 56, shown in dot-and-dashed line in FIG. 6, may also be included for further stabilizing the base. When a ballast bag is used with the base 70, it should have an opening 62 (see generally FIG. 4), which is sufficient for the ballast bag to slip over the cone 72.

FIGS. 7 and 8 illustrate yet another way for maintaining the display device in place. Specifically, in this embodiment, the bottom support pole 28 terminates in a pointed stake 80, which is thrust into the ground 82. Thus, this arrangement allows the display device 10 to be maintained in place when the device is to be used on other than pavement or other hard surface, for example, when the display device 10 is used at a construction site, or on a dirt shoulder of a roadway or similar "unpaved" surface.

FIGS. 9 and 10 illustrate, in schematic form, variations of the "basic" configurations disclosed previously. For example, FIG. 9 shows a display device 10 having a base 72 supporting a staff 14. Staff 14 terminates in three branches, 14*a*, 14*b* and 14*c*, with each branch including a flag 20. In a similar fashion, FIG. 10 illustrates, in schematic form, a display device 10 having two bases 72, each supporting a staff 14. One staff 14 terminates in a flag 20, while the other staff terminates in a battery-operated signal device 16. The two staffs 14 are connected together by a barricade 84. This configuration is particularly useful at construction sites.

As indicated previously, the display device according to the present invention has wide applicability, especially to control the flow of vehicular traffic or to warn of other dangers or obstructions. The display device may be erected and subsequently disassembled quickly and easily. When assembled, the display device is maintained in position against winds and other forces caused, for example, by the flow of vehicular traffic adjacent the device. The display device has a high degree of "visibility", both during the daytime and when the device is used at night. It is lightweight, may be fabricated relatively inexpensively, and has replacable and interchangable parts.

Having described the structural configuration of the display device, the use of the display device will be apparent.

Display device 10 may, for purposes of storage, be in a "knocked down" condition. In a typical technique for erecting the display device, the user first places in position the base 12. For those situations where the display device 10 is to remain in position for a relatively long period of time, it is advantageous for the wire 64 of the battery pack to extend through the hollow, inner portion of the staff 14. Accordingly, the user takes the end 64*a* of the wire and threads the wire through the opening 66 located through the circular plate 46. The wire may be threaded through this opening either from around the base or through hole 68 adjacent socket 48.

The ballast bag 56 is then placed over the base, so that the opening 62 of the ballast bag fits around the socket 48 of the base and the battery pack 18 is typically placed, for convenience, on the ballast bag (see FIG. 4).

After the wire is pulled through hole 66, the wire is then "threaded" through the hollow, inside of staff 14. In order to accomplish this in a relatively easy fashion, the wire may be threaded through staff 14 before the various support poles are connected to each other. Thus, the wire is threaded through the various support poles, until the end 64*a* of the wire reaches the base 38 of the battery-operated signal device, which is maintained in cap 40. The wire 64*a* is then "plugged into" the bottom of base 38, thereby providing an electrical path from light 36 to the battery pack 18.

After this has been accomplished, the various support poles are inserted, one into the other, in order to provide the staff 14. The number of these support poles is a function of the desired height for the display device—the overall height for the display device being longer if two support poles are used than if only one support pole is used, but shorter than if three support poles were used to form the staff 14. It should be noted that the support poles fit one into the other relatively easily, since the narrow extension of the wall of the support pole is adapted to frictionally fit into the wider end of the adjacent pole. For the case where two support poles are utilized, as illustrated in FIG. 1, the top support pole 26 is inserted into the bottom support pole 28, until shoulders 32 and 34 of the two support poles abut each other.

The bottom support pole may then be placed into socket 48 of base 12 and the cap 40, carrying the signal device 16, is inserted at the top of top support pole 26. Of course, the particular order in which the staff is erected is a matter of choice—the staff may be completely erected before it is inserted into the base or the staff may be built up in steps, by first inserting the bottom support pole within the base, etc.

The display device 10 is then ready for use in warning either oncoming cars of an obstruction in a traffic lane, or pedestrians of a dangerous condition at a construction site or the like. The display device is highly visible during the daytime, since the device is advantageously painted with high-visibility colored paint. The display device is also highly visible at night, since the flag includes a reflective surface and since the battery-operated signal device provides a further visual indication signal. This may either be a constant signal or may be a flashing signal, depending on the nature of battery pack 18.

It is to be noted that the base 12 provides a stable support for the display device and, along with the ballast bag 56, prevents the display device from being knocked-down by the wind created by passing traffic, as but one example.

For those cases where the display device is not to remain in place for a relatively long period of time, time may be saved by having the wire 64 of the battery pack travel up to the signal device 16 along the outside of staff 14. For this case, the end 64*a* of the wire is inserted through an appropriate side opening in cap 40, so that the wire may be plugged into the side of base 38, to provide the path of conduction between the light 36 and the battery pack.

To disassemble the display device, the procedure is reversed.

The same procedure in erecting and thereafter disassembling the display device is also followed with respect to use of the base shown in FIG. 6. In this case, the bottom support pole 28 is inserted into the opening 78 of the cone 72. To provide further stability for the base, the cone may be separately weighted or ballast may be inserted within the cone.

When using the base shown in FIGS. 7 and 8, the staff is maintained in place by the stake 80 which is thrust into the ground. For this configuration, the wire 64 is located outside staff 14.

It has been found that using display devices according to the present invention provides effective signal devices for purposes of traffic control and other warning conditions. The device is highly visible, can be erected easily at the site where it is to be used and, once erected, is maintained at its position. It may be fabricated relatively inexpensively, thereby decreasing costs. It is compact, lightweight, easy to assemble and easy to store. Its break-away construction also serves as an added safety feature.

The display device provides consistent and safe lane closure, at various traffic rates of speed, from slow-moving city traffic to high-speed interstate trasfic. It may be used by construction crews or traffic officials on highways and construction sites or by a motorist who is stranded on the highway in an emergency situation. The display device may have a barricade configuration, multi-flag configuration, or similar configurations which are "built-up" from the basic configuration shown in FIGS. 1 and 6.

Numerous modifications are possible in light of the above disclosure. For example, further devices to enhance the visibility of display device 10 may be provided. Thus, as illustrated in FIGS. 1 and 3, the display device may include a triangle 86 formed of a plurality of pivotally connected legs 88, 90, 92 and 94 and formed of a reflective material, adapted to be suspended from a location on one or more of the support poles forming staff 14; for example, supported by fastening the triangle to a screw 96 projecting from support pole 28 (see FIG. 3). For compactness, legs 88 and 90 are pivoted together, legs 88 and 92 are pivoted together, and legs 90 and 94 are pivoted together about rivets 95, with legs 88 and 90 being substantially equal in length and larger than legs 92 and 94, the latter legs overlapping each other at 98 and cupled by attachment means such as clip 100 to form the lower side of the triangle. The screw 96 may conveniently fit into rivet 95. Other screws, 96*a* and 96*b*, may be provided for locating triangle 86 at different heights, relative to staff 14. When not in use, the triangle may be collapsed by removing clip 100 and rotating the legs and/or it may be removed from staff 14. It is to be understood, therefore, that the above-described embodiments are merely illustrative and other embodiments may be devised by those skilled in the art, without departing from the spirit or scope of the present invention, as set forth in the appended claims.

What I claim is:

1. A display device comprising a relatively flat base, and including a plurality of outwardly directed arms extending from the base, each of said arms terminating in a support leg for the base, said arms arranged in pairs with each pair including a short arm and a long arm; a staff supported by said base; said base further including means for receiving one end of said staff; and a signal device, located at the other end of said staff, for providing a visual indication of the presence of the display device.

2. A display device according to claim 1, wherein the staff includes at least two support poles removably connected together.

3. A display device according to claim 2, wherein at least one of the support poles terminates in an extension and at least one of the other support poles terminates in a cavity adapted to receive the extension of an adjacent support pole.

4. A display device according to claim 3, wherein the support poles are hollow.

5. A display device according to claim 4, wherein the signal device includes a cap connected to one of the support poles, said cap carrying a source of illumination disposed thereon.

6. A display device according to claim 5, further including a battery pack for powering the sorce of illumination and means for connecting the signal device to the battery pack.

7. A display device according to claim 6 wherein the means for connecting the battery pack to the signal device is a wire adapted to be threaded through the hollow portion of the support poles.

8. A display device according to claim 1 wherein the means for receiving one end of the staff is a socket disposed at the center of the base.

9. A display device according to claim 1 wherein the means for receiving one end of the staff includes a cone connected at one end to the base and having an open end at the other end thereof for receiving the staff.

10. A display device according to claim 2 further including a flag connected to one of said support poles.

11. A display device according to claim 1 further including a ballast bag adapted to fit over the base.

12. A display device according to claim 1 wherein the signal device includes a plurality of flags, said display device further including means for holding said flags in extended positions.

13. A display device according to claim 2, further including a triangle connected to one of said support poles, said triangle formed of a plurality of legs pivotally connected together.

14. A display device according to claim 13, wherein the legs of said triangle are of a reflective material.

15. A display device according to claim 1, wherein said base includes four pairs of arms.

16. A display device according to claim 15, wherein said pairs of arms are disposed at appproximately 90° intervals about said base.

17. A display device according to claim 16, wherein a short arm of a pair of arms is generally aligned with but opposite from a long arm of an opposite pair of arms.

* * * * *